United States Patent [19]

Spangenberg

[11] 4,077,370

[45] Mar. 7, 1978

[54] INTERNAL COMBUSTION ENGINE FUEL ECONOMY IMPROVEMENT SYSTEM

[76] Inventor: Harold E. Spangenberg, 7346 Via Amorita, Downey, Calif. 90241

[21] Appl. No.: 606,042

[22] Filed: Aug. 19, 1975

[51] Int. Cl.[2] ..... F02B 11/08

[52] U.S. Cl. ..... 123/103 B; 123/103 C

[58] Field of Search ..... 123/97 R, 103 R, 103 C, 123/98, 103 B; 180/108

[56] References Cited

U.S. PATENT DOCUMENTS

| | | | |
|---|---|---|---|
| 2,139,832 | 12/1938 | Leibing | 123/103 C |
| 2,529,437 | 11/1950 | Weinberger | 123/103 C |
| 2,585,814 | 2/1952 | McDonald | 123/103 C |
| 2,627,850 | 2/1953 | Willim | 123/103 C |
| 2,825,418 | 3/1958 | Kershman | 180/77 |
| 3,289,659 | 12/1966 | Koole | 123/103 C X |
| 3,769,951 | 11/1973 | Holl | 123/103 E X |
| 3,861,490 | 1/1975 | Sakakibara | 123/103 R |
| 3,923,020 | 12/1975 | Gilligan | 123/103 C |

FOREIGN PATENT DOCUMENTS

| | | | |
|---|---|---|---|
| 751,217 | 10/1933 | France | 180/108 |
| 905,559 | 3/1954 | Germany | 123/103 C |

*Primary Examiner*—Charles J. Myhre
*Assistant Examiner*—Craig R. Feinberg
*Attorney, Agent, or Firm*—Benoit Law Corporation

[57] ABSTRACT

Apparatus and methods are disclosed for assisting the driver of an automobile driven by a drive system including an internal combustion engine to improve fuel economy. The internal combustion engine drive system has an air intake manifold, a throttle valve, an accelerator pedal and a linkage coupling the accelerator pedal to the throttle valve. The effective length of the linkage between the accelerator pedal and the throttle valve is biased to an extreme value at which the throttle valve is in a closed position when the engine is deactivated. The existence and intensity of a vacuum in the air intake manifold is determined. The effective length of the mentioned linkage is maintained biased at the extreme value at vacuum intensities up to a vacuum intensity existing in the air intake manifold at an idling rate of rotation of the internal combustion engine. On the other hand, the effective length of the mentioned linkage is varied so as to actuate the throttle valve toward a closing position in response to vacuum intensities above the vacuum intensity existing at the idling rate of rotation.

41 Claims, 5 Drawing Figures

INTERNAL COMBUSTION ENGINE FUEL ECONOMY IMPROVEMENT SYSTEM

BACKGROUND OF THE INVENTION

1. Field of the Invention

The subject invention relates to systems for improving fuel economy and, more specifically, to methods and apparatus for assisting the driver of an automobile driven by an internal combustion engine to improve fuel economy with the aid of a device in the linkage coupling the accelerator pedal to the throttle valve and with the aid of the air intake manifold vacuum.

2. Description of the Prior Art

It has been known for some time that reading of the vacuum in the air intake manifold of an internal combustion engine can be used to improve fuel economy. To this end, major automobile manufacturers have started to offer a built-in vacuum indicator which measures and indicates to the driver the difference in pressure between the atmosphere outside the engine and the air inside the intake manifold. Further uses and refinement of such vacuum gauges have been described in Popular Science, March 1975, "Why Your Car Needs a Vacuum Gauge", pages 110 to 112.

In practice, there prior-art devices require driving "with one eye on the vacuum gauge", which is distractive to many drivers and thus tends to lead to accidents. Conversely, a conscientious driver who is paying attention to the road and the surrounding traffic situation is many times not in a position to observe the vacuum gauge. Moreover, special skills, experience and a high degree of calmness are required for an intelligent reading and use of a vacuum gauge during the operation of an automobile. Also, while such vacuum gauges will point to engine defects or maladjustments, they do not provide for a full utilization of the intake manifold vacuum condition throughout the course of normal driving with a well operating engine.

Prior-art efforts to provide vacuum-responsive engine control devices in the linkage between the accelerator pedal and the throttle valve have not led to a desired level of fuel economy.

In particular, the governor for internal combustion engines shown in U.S. Pat. No. 2,139,832, issued Dec. 13, 1938 to W. E. Leibing, had the disadvantage of introducing surges in the rate of rotation of the controlled engine. The vacuum controlling device shown in U.S. Pat. No. 2,627,850, issued Feb. 10, 1953, to R. Willim, in effect kept the vacuum in the air intake manifold at a minimum to increase horse power on acceleration.

The engine control system of U.S. Pat. No. 3,289,659, issued Dec. 6, 1966, to P. J. Koole, was impractical in its complexity and sensitivity to malfunction. A newer proposal, apparent from U.S. Pat. No. 3,769,951, by William H. Holl, issued Nov. 6, 1973, attempts to decrease undesirable exhaust emissions in response to sudden, jerky accelerator pedal actuation by nervous drivers, rather than concentrating on fuel economy as such.

SUMMARY OF THE INVENTION

It is a broad object of this invention to overcome the above mentioned disadvantages.

It is a more specific object of this invention to provide improved methods and apparatus for assisting drivers of automobiles driven by internal combustion engines to improve fuel economy.

It is a further object of this invention to provide improved apparatus for varying the effective length of the linkage between the accelerator pedal and the throttle valve in response to the air intake manifold vacuum.

Other objects of the invention will become apparent in the further course of this disclosure.

From a first aspect thereof, the subject invention resides in a method of assisting the driver of an automobile driven by a drive system including an internal combustion engine to improve fuel economy. The internal combustion engine drive system has an air intake manifold, a throttle valve, an accelerator pedal and a linkage coupling the accelerator pedal to the throttle valve. The invention according to this aspect resides in the improvement comprising in combination the steps of biasing the effective length of said linkage between said accelerator pedal and said throttle valve to an extreme value at which said throttle valve is in a closed position when said engine is deactivated, determining the existence and intensity of a vacuum is said air intake manifold, maintaining the effective length of said linkage biased at said extreme value at vacuum intensities up to a vacuum intensity existing in said air intake manifold at an idling rate of rotation of said internal combustion engine, varying the effective length of said linkage so as to actuate said throttle valve toward a closing position in response to vacuum intensities above said vacuum intensity existing at said idling rate of rotation, and inhibiting surges in the operation of said engine by stopping the effective length of said linkage at said extreme value at vacuum intensities occurring upon actuation of said accelerator pedal and being below said vacuum intensity existing at said idling rate of rotation.

From another aspect thereof, the subject invention resides in apparatus for assisting the driver of an automobile driven by a drive system including an internal combustion engine to improve fuel economy. The internal combustion engine drive system includes an air intake manifold, a throttle valve, an accelerator pedal and a linkage coupling the accelerator pedal to the throttle valve. The invention according to this aspect resides, more specifically, in the improvement comprising, in combination, means in said linkage for varying the effective length of said linkage between said accelerator pedal and said throttle valve, means in said length varying means for limiting the effective length of said linkage between said accelerator pedal and said throttle valve to an extreme value at which said throttle valve is in a closed position when said engine is deactivated, means coupled to said throttle valve for biasing said throttle valve to a closed position when the effective length of said linkage is at said extreme value and said engine is deactivated, means connected to said air intake manifold for determining the existence and intensity of a vacuum in said air intake manifold, means in said length varying means for biasing the effective length of said linkage to said extreme value up to a vacuum intensity existing in said air intake manifold at an idling rate of rotation of said internal combustion engine, means in said length varying means and connected to said vacuum existence and intensity determining means for activating said throttle valve toward a closing position by variation of the effective length of said linkage in response to vacuum intensities above said vacuum intensity existing at said idling rate of rotation, and means for inhibiting surges in the operation of said engine comprising stop means in said limiting means for stopping the effective length of said linkage at said extreme value at vacuum intensities occurring upon actuation of said accelerator pedal and being below said vacuum intensity existing at said idling rate of rotation.

From yet another aspect thereof, the invention resides in apparatus for varying the effective length of a linkage between an accelerator pedal and a throttle valve of an automatic engine having an air intake manifold, with said linkage having a first linkage part coupled to said accelerator pedal and a second linkage part coupled to said throttle valve and with said throttle valve being biased to a closed position. According to this aspect of the invention, the apparatus comprises an enclosure coupled to one of said first and second linkage parts and means for slidably receiving a portion of the other of said first and second linkage parts, means at said enclosure for limiting the effective length of said linkage between said accelerator pedal and said throttle valve to an extreme value at which said throttle valve is in a closed position when said engine is deactivated, means connected to said enclosure and to said air intake manifold for determining the existence and intensity of a vacuum in said air intake manifold, means in said enclosure for biasing the effective length of said linkage to said extreme value up to a vacuum intensity existing in said air intake manifold at a predetermined condition of said internal combustion engine, and an imperforate flexible diaphragm in said enclosure, means for coupling said portion of the other linkage part to said diaphragm, a variable size vacuum chamber delimited in said enclosure by said flexible diaphragm and connected to said vacuum existence and intensity determining means and positioned in said enclosure to cause said flexible diaphragm to vary the effective length of said linkage in the sense of a closure of said throttle valve in response to vacuum intensities above said vacuum intensity existing at said predetermined condition, and means for inhibiting surges in the operation of said engine comprising stop means in said limiting means for stopping the effective length of said linkage at said extreme value at vacuum intensities occurring upon actuation of said accelerator pedal and being below said vacuum intensity existing at said idling rate of rotation.

From still another aspect thereof, the invention resides in a method of assisting the driver of an automobile driven by a drive system including an internal combustion engine to improve fuel economy. The internal combustion engine drive system has an air intake manifold, a throttle valve, an accelerator pedal and a linkage coupling the accelerator pedal to the throttle valve. The invention according to this aspect resides in the improvement comprising in combination the steps of biasing said throttle valve toward a closed position, accelerating said engine by opening said throttle valve, determining the existence and intensity of a vacuum in said air intake manifold, varying the effective length of said linkage so as to actuate said throttle valve toward a closing position in response to vacuum intensities above a vacuum intensity existing at an idling rate of rotation of said internal combustion engine, and inhibiting surges in the operation of said engine by stopping the effective length of said linkage at an extreme value at vacuum intensities occurring upon acceleration of said engine and being below a vacuum intensity existing in said air intake manifold at an idling rate of rotation of said internal combustion engine.

From yet another aspect thereof, the invention resides in apparatus for assisting the driver of an automobile driven by a drive system including an internal combustion engine to improve fuel economy. The internal combustion engine drive system includes an air intake manifold, a throttle valve, an accelerator pedal and a linkage coupling the accelerator pedal to the throttle valve. The invention according to this aspect resides, more specifically, in the improvement comprising, in combination, means in said linkage for varying the effective length of said linkage between said accelerator pedal and said throttle valve, means in said length varying means for biasing the effective length of said linkage between said accelerator pedal and said throttle valve to an extreme value at which said throttle valve is in a closed position when said engine is deactivated, means coupled to said throttle valve for biasing said throttle valve to a closed position, means connected to said air intake manifold for determining the existence and intensity of a vacuum in said air intake manifold, means in said length varying means and connected to said vacuum existence and intensity determining means for activating said throttle valve toward a closing position by variation of the effective length of said linkage in response to vacuum intensities above said vacuum intensity existing at said idling rate of rotation, and means for inhibiting surges in the operation of said engine including stop means at said length varying means for maintaining the effective length of said linkage limited to an extreme value at vacuum intensities occurring upon acceleration of said engine and being below a vacuum intensity existing in said air intake manifold at an idling rate of rotation of said internal combustion engine.

BRIEF DESCRIPTION OF THE DRAWINGS

The invention will become more readily apparent from the following detailed description of preferred embodiments thereof, illustrated by way of example in the accompanying drawings, in which like reference numerals designate like or functionally equivalent parts, and in which.

DESCRIPTION OF PREFERRED EMBODIMENTS

Figure 1:
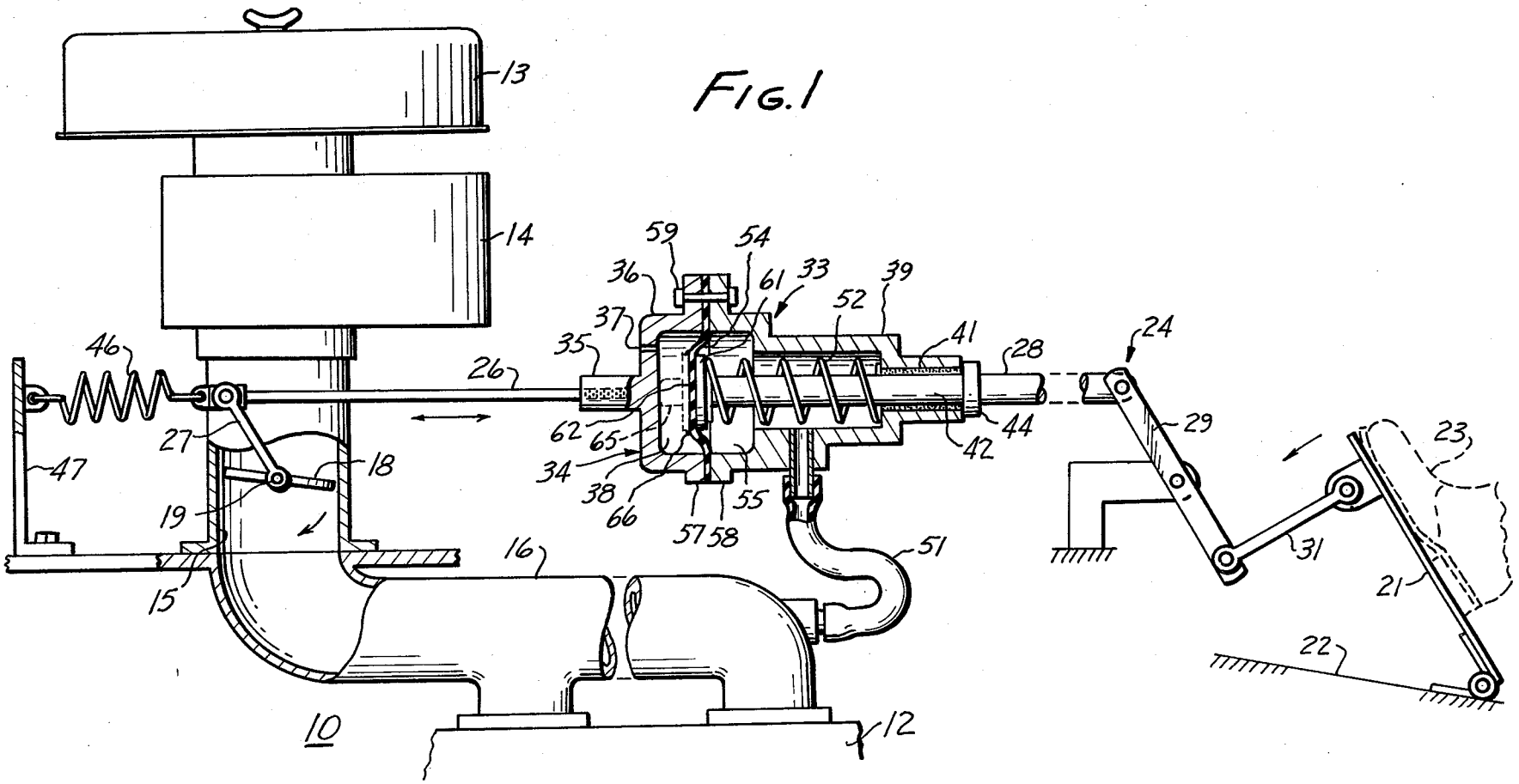
FIG. 1 is a side view, partially in section, of a portion of an automotive internal combustion drive system and of a fuel economy device in accordance with a preferred embodiment of the subject invention.

FIG. 1 shows parts of an automotive internal combustion engine system 10 including an internal combustion engine 12, such as an automotive gasoline engine. The system 10 also includes an air intake filter 13, a carburetor 14 receiving air from the filter 13, and a a fuel, such as gasoline, from a fuel supply or gasoline tank, an induction passage 15 and an air intake manifold 16 for the engine 12.

A butterfly or throttle valve 18 is pivotally mounted by a shaft 19 in the induction passage 15.

A gas pedal 21 in the driver's compartment of the automobile is pivotally mounted on a floorboard 22 for actuation by one of the driver's feet 23 for a speed control of the automobile by means of the gas or accelerator pedal 21.

A linkage 24 couples the accelerator pedal 21 to the throttle valve 18. The linkage 24 includes a first linkage part or rod 26 coupled to the throttle valve 18 via a lever 27, and a second linkage part or rod 28 coupled via a lever 29 and a pushrod 31 to the accelerator pedal 21. In practice, the parts 29 and 31 may be replaced by a Bowden wire or similar device, as customary in automotive construction.

Pursuant to the subject invention, the equipment shown in FIG. 1 includes an apparatus 33 for varying the effective length of the linkage 24 between the accelerator pedal 21 and the throttle valve 18. The apparatus 33 has a housing or enclosure 34 which at a nipple 35 is coupled to either of the first and second linkage rods 26 and 28. In the illustrated preferred embodiments, the housing 34 is connected to the throttle valve rod 26 by a threaded nipple 35.

Enclosure 34 has a first part 36 which has an orifice 37 for the access of air to an air chamber 38.

The enclosure 34 also includes an enclosure part 39 which carries an airtight bushing 41 for slidably receiving a portion 42 of the other of the first and second linkage parts or rods 26 and 28. In the illustrated preferred embodiment, the enclosure and bushing 41 slidably receives a portion of the accelerator pedal linkage rod 28. However, in embodiments wherein the enclosure 34 is connected to the accelerator pedal linkage rod 28, the enclosure and bushing 41 would be designed to slidably receive a portion of the throttle valve linkage rod 26.

It should be noted at this juncture that the portion 42 which is slidably received in the airtight bushing 41 need not necessarily be a physical portion of the entire rod 28 which extends to the lever 29.

Rather, the portion 42 may be part of a rod which, in turn, is coupled to yet another rod that extends to the lever 29. This is a matter of mechanical detail and design.

The apparatus 34 includes a stop member 44 for limiting the effective length of the linkage between the accelerator pedal 21 and the throttle valve 18 to an extreme value at which the throttle valve 18 is in a closed position when the engine 12 is deactivated. Whether this extreme value represents a maximum length or a minimum length of the variable linkage 24 depends on the design of the engine system. With the throttle valve and accelerator system shown in FIGS. 1 to 3, the extreme value to which the stop 44 limits the effective length of the linkage 24 is a minimum value.

Figure 2:
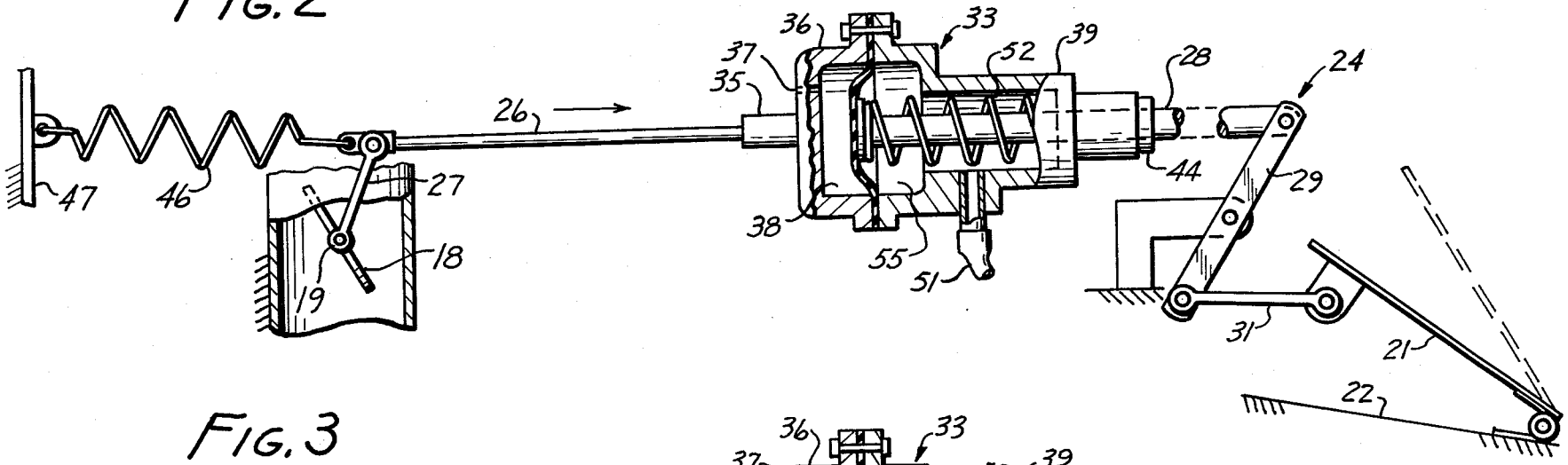
FIGS. 2 and 3 are views similar to FIG. 1 showing different operating conditions of the system.
Figure 3:
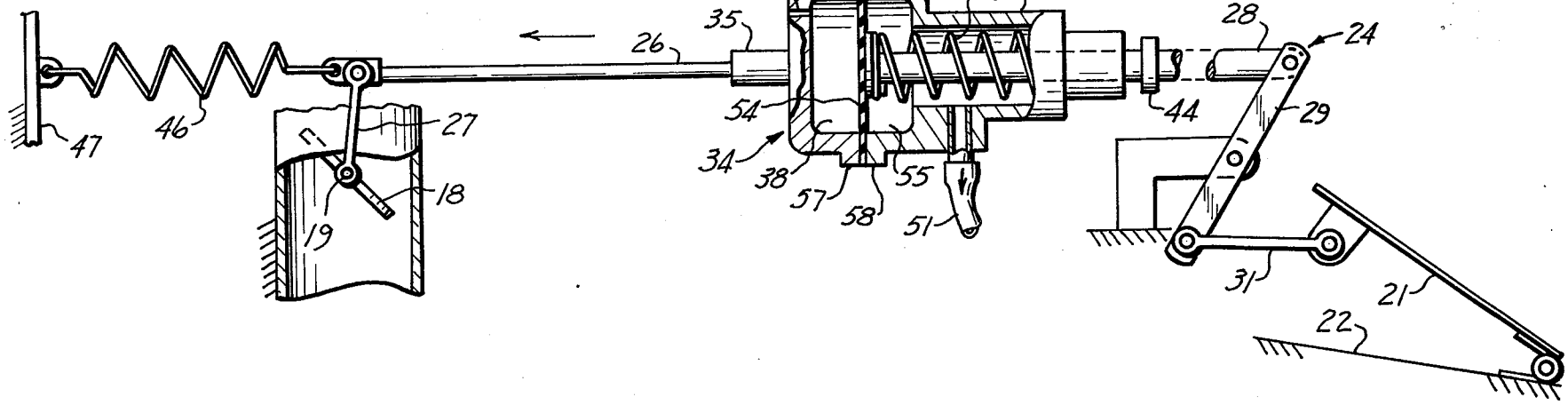

The equipment shown in FIGS. 1 to 3 also include a bias spring 46 for biasing the throttle valve 18 to a closed position when the effective length of the linkage 24 is at its extreme or minimum value and the engine 12 is deactivated. To this end, the spring 46 has one end connected to a stationary bracket 47 and has its other end coupled to the throttle valve 18 via the lever 27.

A conduit 51 is connected to the intake manifold 16 for determining, in effect, the existence and intensity of a vacuum in the air intake manifold 16 of the engine 12.

A spring 52 in the apparatus 33 or, more precisely, in its enclosure part 39, biases the effective length of the linkage 24 to its extreme or minimum value up to a vacuum intensity existing in the air intake manifold 16 an an idling rate of rotation of the internal combustion engine.

The latter feature is very important in the operation of the subject invention. This does not necessarily mean that the spring 52 always has to maintain the length of the linkage 24 at its extreme value precisely up to a vacuum intensity existing in the air intake manifold at a fixed idling rate of rotation of the engine 12. Rather, the idling rate of rotation may itself be somewhat variable or adjustable within reasonable limit and the vacuum intensity up to which the length of the linkage 24 is biased by the spring 52 to its extreme value may be within a certain tolerance of the exact vacuum intensity which exists in the manifold 16 at a given idling rate of rotation of the engine 12.

The importance of the inventive feature under discussion thus resides not in a slavish adherence to one precise vacuum intensity, but rather in an avoidance of undesirable and detrimental surging effects which occur if the apparatus 33 is permitted to carry out its linkage length varying function at vacuum intensities materially below the idling speed vacuum intensity, or the lack of response which would occur if the apparatus 33 were to maintain the extreme length of the linkage 24 up to vacuum intensities materially above the idling speed vacuum speed intensity.

In accordance with the currently discussed aspect of the invention, the force exerted by the bias spring 52 is thus provided and maintained within relatively narrow tolerances, so that this spring 52 maintains the length of the linkage 24 biased to its extreme value up to an idling rate vacuum intensity within $\pm 1$ inch Hg.

The importance of this feature of the currently discussed aspect of the subject invention can be appreciated from the fact that it was a lack of this principle which was responsible for excessive surges with resulting uselessness of proposals such as those disclosed in the above mentioned Leibing U.S. Pat. No. 2,132,832, eventuating in immeasurable losses and grave disappointments on the part of workers in this field and in a regrettable delay of the advent of a workable system that would truly contribute to a conservation of limited fuel resources.

The apparatus 33 further includes means connected to the manifold 16 via conduit 51 for activating the throttle valve 18 toward a closing position by variation of the effective length of the linkage 24 in response to vacuum intensities above the vacuum intensity existing at the idling rate of rotation of the engine 12. In the illustrated preferred embodiments, these means include an imperforate flexible diaphragm 54 in the enclosure of the apparatus 33. By way of example, the imperforate diaphragm 54 may be made of an elastomer disk mounted between the enclosure parts 36 and 39.

The expression "imperforate" as herein employed refers to the condition of the diaphragm 54 inside the enclosure between the air chamber 38 and a vacuum chamber 55 presently to be described; and refers in particular to the fact that there is no aperture in the diaphragm 54 in that air and vacuum chamber region. Of course, there may be one or more apertures in the diaphragm outside the air and vacuum chambers 38 and 55, where there is no danger of any air leakage or of any stress being placed on the diaphragm portion within the enclosure by any attached rod or other movable parts.

The enclosure parts 36 and 39 may have flanges 57 and 58 between which the diphragm 54 is situated. Suitable fastening devices, one of which is shown at 59, may be employed to mount the enclosure parts 36 and 39 and a diaphragm 54 to an operative unit. These fasteners, such as the fastener 59 may extend through an aperture in the disk comprising the diaphragm 54 which, as mentioned above, is imperforate throughout the region occupied by the air and vacuum chambers 38 and 55.

The linkage length varying means under consideration further include the bias spring 52 and a member 61 for coupling the portion 42 of the linkage part or rod 28 to the imperforate diaphragm 54. In the illustrated preferred embodiment, the member 61 is connected or attached to the rod portion 42 and has a surface 62 facing the imperforate diaphragm 54 and being biased toward that diaphragm by the spring 52.

Where the rod 28 is cylindrical, the coupling member 61 with its facing surface 62 is rotatable relative to the imperforate diaphragm 54. By way of example, the coupling member 61 preferably has a circular configuration at the facing surface 62 and is rotatable relative to the imperforate diaphragm 54 about an axis perpendicular to the facing surface 62. While rotation of the member 61 is not an operational requirement of the apparatus 33, it should be recognized that rotatability of that member will greatly increase the reliable operation of the apparatus 33 since it will prevent perforation or any other damage to the diaphragm 54 from an affixed member. For instance, rotation of the member 61 relative to the diaphragm 54 may occur if the projecting portion of the rod 28 is manipulated during the installation or use of the apparatus 33. This favorably distinguishes the apparatus according to the illustrated preferred embodiment from prior-art device, such as those shown in US Pat. Nos. 2,139,832 and 3,769,951, where a rotatable rod was attached to a diaphragm or bellows and thereby was liable to damage the bellows through tortional or shearing loads when the attached rod was subjected to rotary movement during installation or use of the device.

In principle, the stop or limit member 44 could be replaced or supplemented by a stop member of the type shown in dotted outline at 65 in FIG. 1. That kind of stop member would also limit the effective length of the linkage 24 between the accelerated pedal and the throttle valve to an extreme value at which the throttle valve 18 is in a closed position when the engine 12 is deactivated. In either case, the stop member by its limiting or stopping action performs the very important function or inhibiting excessive acceleration or surges by operation of the linkage length varying apparatus in case of low vacua occuring in the manifold 16 upon depression of the pedal 21.

The stop member 65, if used, would be located inside the enclosure 34 and, if desired, could be attached or bonded to the imperforate diaphragm 54 by an adhesive 66.

In accordance with a preferred embodiment of the subject invention, use of the stop member 44 outside of the enclosure 34 and on the rod 28 is preferred, as this is the construction most likely to prevent damage to or excessive wear of the imperforate diaphragm 54. By way of example, the stop member 44 may be in the form of a ring shrunk unto or otherwise affixed to the linkage part 28 outside of the enclosure 34 or its part 39 or may be threaded on 28 for adjustability.

Figure 5:
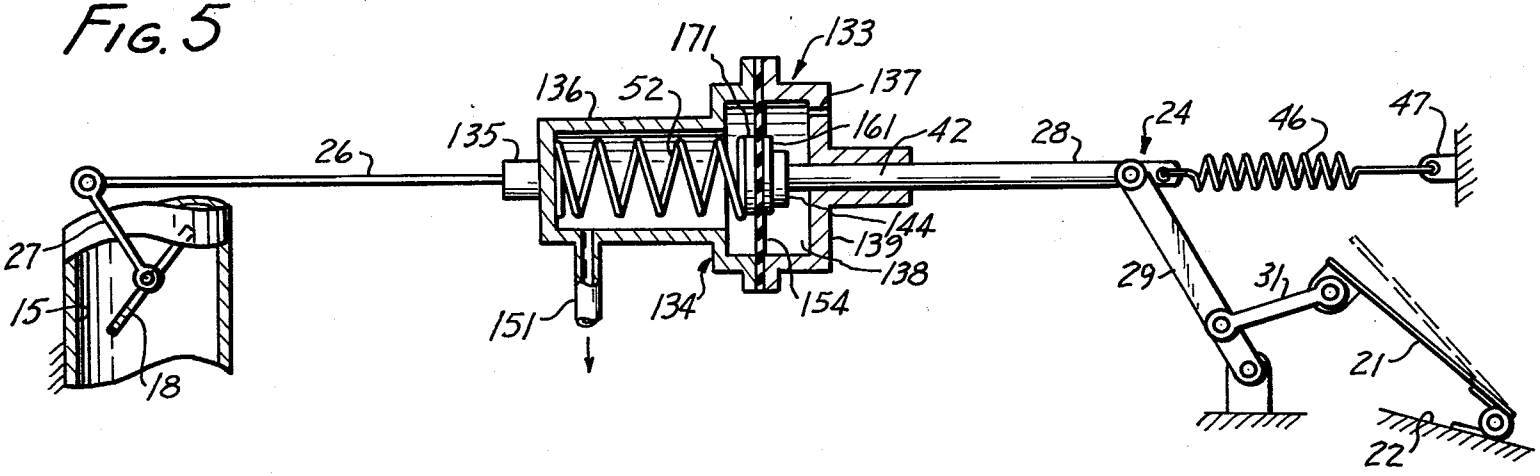
FIGS. 4 and 5 are views similar to FIGS. 1–3, showing the construction and operation of a fuel economy device in accordance with a further preferred embodiment of the subject invention.
Figure 4:
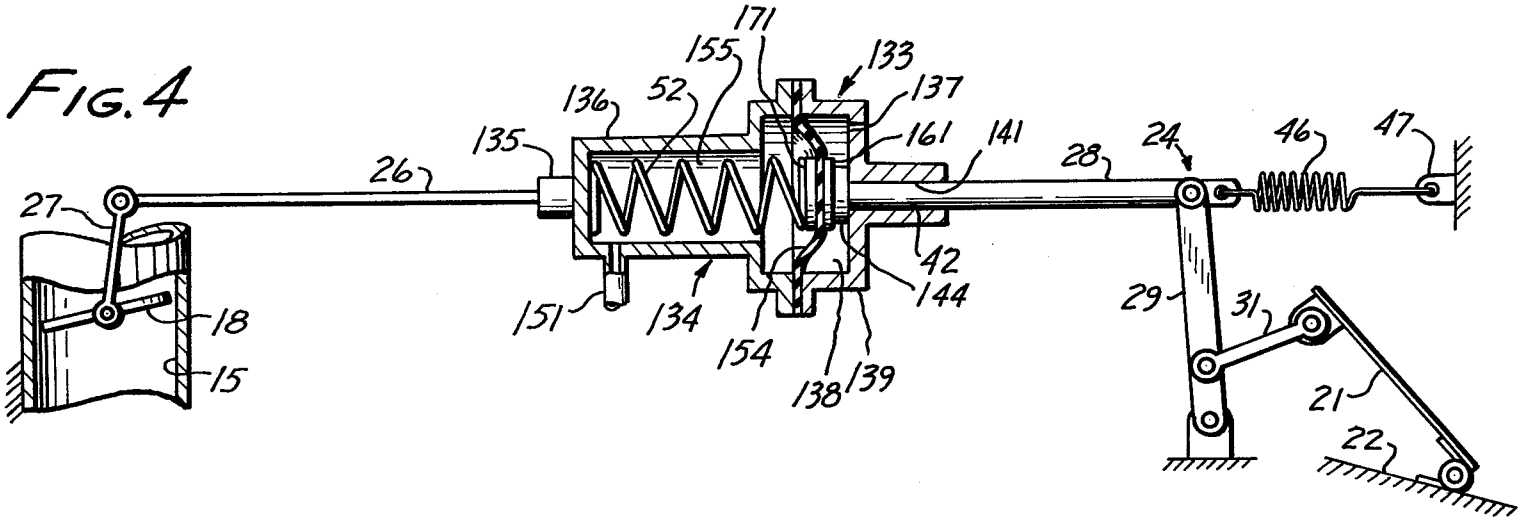

The advantageous construction details discussed with respect to the apparatus 33 and to be discussed with respect to the apparatus shown in FIGS. 4 and 5, may advantageously be employed in equipment for varying the effective length of a linkage between an accelerator pedal and a throttle valve of an automotive engine in which the spring 52 or its equivalent does not necessarily bias the effective length of the linkage 24 to the mentioned extreme value up to a vacuum intensity existing in the air intake manifold 16 at an idling rate of rotation of the internal combustion engine 12. In other words, the detail improvements are more universally applicable than even the broad concept of that aspect of the invention which deals with the achievement of a maximum of fuel economy.

On the other hand, the broad aspects of the invention concerned with fuel economy may be realized by equipment other than those including the improvements shown in the drawings.

In particular, the diaphragm 54 may be replaced by a piston which slides in the housing 34 as an alternative displacement means for varying the length of the linkage 24. In practice, a diaphragm 54 has proved to be superior to a sliding piston, as the drag of a piston relative to the cylinder chamber has impaired the precision of operation of the length varying apparatus.

The apparatus 33 further includes the variable size vacuum chamber 55 delimited by the flexible diaphragm 54 and positioned in the enclosure 34 or enclosure part 39 to vary the effective length of the linkage 24 in the sense of a closure of the throttle valve 18 in response to vacuum intensities above the vacuum, intensity existing at the idling rate of rotation of the engine 12. In this connection, the diaphragm 54 and vacuum chamber 55 will cooperate to increase the effective length of the linkage 24 if the stop 44 limits the effective length at a minimum value and if the increase of that effective length will translate itself into a closing movement of the throttle valve 18 in the particular design of the automotive equipment.

These principles will now be explained with the aid of FIGS. 1 to 3.

Considering first FIG. 1, it will be assumed that the engine has just been started with the accelerator pedal being not depressed at that time and the throttle valve 18 being in a closed position. With a typical automotive internal combustion engine in good condition, the vacuum in the intake manifold 16 and thus in the vacuum chamber 55 of the apparatus 33 will be steady at between 17 and 21 inches of Hg at the idling rate of rotation of the engine 12. In that condition, the spring 52 maintains the effective length of the linkage 24 at the mentioned extreme or minimum value.

A depression of the accelerator pedal 21 operates through the linkage 24 to open the throttle 18 as shown in FIG. 2 for an acceleration of the engine. With a typical automotive engine, the vacuum in the intake manifold 16 and thus in the vacuum chamber 55 will drop to as low as two in. of Hg upon acceleration of the engine. The spring 52 will continue to maintain the effective length of the linkage 24 at the mentioned extreme or minimum value. This condition prevails as long as the automobile is in the progress of attaining the speed desired by the operator of the pedal 21.

When the desired vehicle speed is attained, or when the vehicle is pulled along by force of gravity, the horsepower load on the engine 12 drops and the vacuum in the intake manifold 16 rises to values or vacuum intensities higher than those prevailing at an idling condition.

The resulting rise in the vacuum intensity or drop in pressure in the intake manifold 16 causes the imperforate diaphragm 54 to overcome the force of the spring 52 and, as shown in FIG. 3, to actuate the throttle valve 18 toward a closing position relative to the open position shown in FIG. 2.

In particular, the increased vacuum in the chamber 55 causes the diaphragm 54 to move the linkage part or rod 28 in the sense of a reduction of the length of the portion 42 in the enclosure 34, whereby the stop member 44 moves with the rod 28 away from the housing 34 by a short distance. In the course of actual operating conditions, the apparatus 33 will effect this increase in the effective length of the linkage 24 very rapidly even before the driver has had an opportunity to take action on the accelerator pedal 21 in response to the decreased horsepower requirements.

Accordingly, the accelerator pedal 21 will have remained in the previously adjusted position when the apparatus 33 effectively lengthens the linkage 24. In consequence, the linkage part or rod 26 will be advanced to the left-hand side as seen in FIG. 3 by the apparatus 33 and the throttle valve 18 will be correspondingly moved toward a closing position.

It will be recognized that the latter action of the apparatus 33 anticipating a control action of the driver is a very important feature of the subject invention. In particular, such automatic action substantially improves fuel economy above and beyond the control capability of the driver.

More specifically, there always is a certain reaction time before a driver realizes that the vehicle has attained a certain speed or that horsepower requirements on the engine have falled off for other reasons, and a further reaction time after such realization before the driver is taking corrective action on the pedal 21. The result of such delayed action is a waste of fuel through a delayed adjustment of the throttle valve 18 to the actual fuel requirements of the engine. These instances of fuel waste are very frequent in the course of normal driving and rapidly cumulate to impair the overall economy of the engine. By contrast, substantial decreases in fuel consumption has been realized by the action of the apparatus 33 according to the subject invention.

FIG. 4 of the drawings corresponds to FIG. 1, but shows a system in which the throttle valve spring 46 biases the throttle valve 18 to a closing position via the linkage 24.

The apparatus 133 shown in FIGS. 4 and 5 corresponds to the apparatus 33 shown in FIGS. 1 and 3, and a reference numeral "1" has been shown in FIGS. 4 and 5 ahead of each reference numeral of a component which has a counterpart in the apparatus of FIGS. 1 to 3. Number prefix "1" has been used in FIGS. 4 and 5 in those cases where it is felt that the parts are identical to those shown in FIGS. 1 to 3, at least for practical purposes.

In the linkage length varying apparatus 133 of FIGS. 4 and 5, the air chamber 138 is defined by the housing part 139 which also includes the bearing 141 for slidably receiving the portion 42 of the linkage part or rod 28. The vacuum chamber 155, which is connected to the intake manifold 16 via a conduit 151 is defined by the housing part 136 and is delimited by the imperforate flexible diaphragm 154.

The housing part 136 is connected or attached to the linkage part or rod 26 by a nipple 135. The bias spring 52 is contained in the housing part 136 and biases the flexible diaphragm 154 via a circular member 171 which may be similar to the member 61 shown in FIG. 1 and which evenly distributes the force of the bias spring 52 over a central area of the diaphragm 154. The member 161 corresponds to the member 61 shown in FIG. 1 and is again attached to the linkage part or rod 28.

The stop 144, which correspnds to the stop 44 shown in FIG. 1, is now located inside the enclosure 134, but is again attached to the linkage part or rod 28. This time, the stop member 144 limits the effective length of the linkage 24 to a maximum value, or stops the travel of portion 42 at a maximum value.

The throttle valve 18 is in a closed position as shown in FIG. 4 when the engine is idling and the accelerator pedal 21 has not been depressed. The bias spring 52 retains the linkage 24 at its extreme or maximum length condition for vacuum intensities up to the intensity prevailing at an idling rate of rotation of the engine. In other words, the spring 52 biases the travel of the portion 42 to a maximum value.

If the accelerator pedal 21 is depressed, the bias spring 52 will still maintain the maximum length of the linkage 24 as long as the vacuum intensity in the intake manifold does not exceed the idling condition vacuum intensity. Adjustments of the accelerator pedal 21 will thus be transmitted to the throttle valve 18 without corrective action by the apparatus 133.

However, when the vacuum intensity in the intake manifold 16 exceeds the idling rate vacuum intensity, the air pressure in the chamber 138 will overcome the force of the bias spring 52 and will push the diaphrgm 154 to the left as seen in FIG. 5. This will lift the stop member 144 off the housing part 139, whereby the effective length of the linkage 24 is shortened. In similarity to the operation of the equipment shown in FIGS. 1 to 3, the apparatus 133 will react before the driver of the vehicle has time to react and will thus move the throttle valve 18 toward a closing position, thereby automatically adjusting the supplied fuel to the actual requirements of the engine at the time.

The diaphragm 154 or a piston used in lieu thereof thus constitutes a displaceable means connected to the portion 42 of the linkage part or rod 28 which delimits a variable size vacuum chamber 155 positioned in the enclosure 134 to cause the diaphragm 154 to move the linkage part or rod 28 in the sense of an increase of the length of the portion 42 of the linkage part or rod 28 in the enclosure 134 in response to vacuum intensities above the vacuum intensity existing at the idling rate of rotation of the engine 12.

In analogy to the embodiment of FIGS. 1 to 3, the embodiment of FIGS. 4 and 5 also results in a very considerable fuel economy by supplementing the control capabilities of the driver.

In practice the housing 134 may be coupled with its nipple 135 to the linkage part or rod 28. In that case the linkage part or rod 26 would be slidably received in part in the busing 141 of the housing part 139 and would be connected to the stop member 144 and coupling member 161. The operation of the apparatus 133 would then in principle be the same as mentioned above in connection with FIGS. 4 and 5.

Various modifications and variations within the spirit and scope of the subject invention will be suggested or rendered apparent by the present extensive disclosure to those skilled in the art.

In practice, use of the equipment of the subject invention substantially decreases pollution by an avoidance of an unncessary combustion of fuel beyond the actual horsepower requriements at each instance.

I claim:

1. A method of assisting the driver of an automobile driven by a drive system including an internal combustion engine to improve fuel economy, said internal combustion engine drive system having an air intake manifold, a throttle valve, an accelerator pedal and a linkage coupling the accelerator pedal to the throttle valve, comprising in combination the steps of:

biasing the effective length of said linkage between said accelerator pedal and said throttle valve to an extreme value at which said throttle valve is in a closed position when said engine is deactivated;

determining the existence and intensity of a vacuum in said air intake manifold;

maintaining the effective length of said linkage biased at said extreme value at vacuum intensities up to a vacuum intensity existing in said air intake manifold at an idling rate of rotation of said internal combustion engine;

varying the effective length of said linkage so as to actuate said throttle valve toward a closing position in response to vacuum intensities above said vacuum intensity existing at said idling rate of rotation; and inhibiting surges in the operation of said engine by stopping the effective length of said linkage at said extreme value at vacuum intensities occurring upon actuation of said accelerator pedal and being below said vacuum intensity existing at said idling rate of rotation.

2. A method as claimed in claim 1, wherein:

the effective length of said linkage between said accelerator pedal and said throttle valve is biased to a minimum value when said engine is deactivated, and said throttle valve is biased toward a closed position when said effective linkage length has said minimum value;

the effective length of said linkage is maintained biased at said minimum value at vacuum intensities up to said vacuum intensity existing in said air intake manifold at said idling rate or rotation;

the effective length of said linkage is increased so as to actuate said throttle toward a closing position in response to vacuum intensities above said vacuum intensity existing at said idling rate of rotation; and surges in the operation of said engine are inhibited by stopping the effective length of said linkge at said minimum value at vacuum intensities occuring upon actuation of said accelerator pedal and being below said vacuum intensity existing at said idling rate of rotation.

3. A method as claimed in claim 1, wherein:

the effective length of said linkage between said accelerator pedal and said throttle valve is biased to a maximum value when said engine is deactivated, and said throttle valve is biased toward a closed position when said effective linkage length has said maximum value;

the effective length of said linkage is maintained biased at said maximum value at vacuum intensities up to said vacuum intensity existing in said air intake manifold at said idling rate of rotation;

the effective length of said linkage is reduced so as to actuate said throttle toward a closing position in response to vacuum intensities above said vacuum intensity existing at said idling rate of rotation; and surges in the operation of said engine are inhibited by stopping the effective length of said linkage at said maximum value at vacuum intensities occurring upon actuation of said accelerator pedal and being below said vacuum intensity existing at said idling rate of rotation.

4. A method of assisting the driver of an automobile driven by a drive system including an internal combustion engine to improve fuel economy, said internal combustion engine drive system having an air intake manifold, a throttle valve, an accelerator pedal and a linkage coupling the accelerator pedal to the throttle valve, comprising in combination the steps of:

biasing said throttle valve toward a closed position;

accelerating said engine by opening said throttle valve;

determining the existence and intensity of a vacuum in said air intake manifold;

varying the effective length of said linkage so as to actuate said throttle valve toward a closing position in response to vacuum intensities above a vacuum intensity existing at an idling rate of rotation of said internal combustion engine; and inhibiting surges in the operation of said engine by stopping the effective length of said linkage at an extreme value at vacuum intensities occurring upon acceleration of said engine and being below a vacuum intensity existing in said air intake manifold at an idling rate of rotation of said internal combustion engine.

5. A method as claimed in claim 4, wherein:

said throttle valve is biased toward a closed position when said effective linkage length has a minimum value;

the effective length of said linkage is increased so as to actuate said throttle toward a closing position in response to vacuum intensities above said vacuum intensity existing at said idling rate of rotation; and surges in the operation of said engine are inhibited by stopping the effective length of said linkage at a predetermined minimum value at vacuum intensities occurring upon acceleration of said engine and being below said vacuum intensity existing in said air intake manifold at said idling rate of rotation.

6. A method as claimed in claim 4, wherein:

said throttle valve is biased toward a closed position when said effective linkage length has a maximum value;

the effective length of said linkage is reduced so as to actuate said throttle toward a closing position in response to vacuum intensities above said vacuum intensity existing at said idling rate of rotation; and surges in the operation of said engine are inhibited by stopping the effective length of said linkage at a predetermined maximum value at vacuum intensities occurring upon acceleration of said engine and being below said vacuum intensity existing in said air intake manifold at said idling rate of rotation.

7. Apparatus for varying the effective length of a linkage between an accelerator pedal and a throttle valve of an automotive engine having an air intake manifold, with said linkage having a first linkage part coupled to said accelerator pedal and a second linkage part coupled to said throttle valve and with said throttle valve being biased to a closed position, comprising:

an enclosure coupled to one of said first and second linkage parts and means for slidably receiving a portion of the other of said first and second linkage parts;

means at said enclosure for limiting the effective length of said linkage between said accelerator pedal and said throttle valve to an extreme value at which said throttle valve is in a closed position when said engine is deactivated;

means connected to said enclosure and to said air intake manifold for determining the existence and intensity of a vacuum in said air intake manifold;

means in said enclosure for biasing the effective length of said linkage to said extreme value up to a vacuum intensity existing in said air intake manifold at a predetermined condition of said internal combustion engine;

an imperforate flexible diaphragm in said enclosure;

means for coupling said portion of the other linkage part to said diaphragm;

a variable size vacuum chamber delimited in said enclosure by said flexible diaphragm and connected to said vacuum existence and intensity determining means and positioned in said enclosure to cause said flexible diaphragm to vary the effective length of said linkage in the sense of a closure of said throttle valve in response to vacuum intensities above said vacuum intensity existing at said predetermined condition; and means for inhibiting surges in the operation of said engine comprising stop means in said limiting means for stopping the effective length of said linkage at said extreme value at vacuum intensities occurring upon actuation of said accelerator pedal and being below said vacuum intensity existing at said idling rate of rotation.

8. Apparatus as claimed in claim 7, wherein:

said limiting means and said surge inhibiting means include stop means attached to said imperforate diaphragm for stopping the travel in said enclosure of said portion of said other linkage part an an extreme value.

9. Apparatus of claim 7, wherein:

said limiting means and said surge inhibiting means include stop means bonded to said imperforate diaphragm by an adhesive for stopping the travel in said enclosure of said portion of said other linkage part at an extreme value.

10. Apparatus as claimed in claim 7, wherein:

said stop means are located outside of said enclosure.

11. Apparatus as claimed in claim 7, wherein:

said stop means include a stop member connected to said other linkage part outside of said enclosure.

12. Apparatus as claimed in claim 7, wherein:

said stop means are located inside said enclosure.

13. Apparatus as claimed in claim 7, wherein:

said stop means include stopping means connected to said portion of the other linkage part in said enclosure.

14. Apparatus as claimed in claim 7, wherein:

said means for coupling said portion of the other linkage part include a member being connected to said portion of the other linkage part in said enclosure and having a surface facing said imperforate diaphragm; and said means for biasing the effective length of said linkage to said extreme value include means for biasing said member with said facing surface toward said imperforate diaphragm.

15. Apparatus as claimed in claim 14, wherein:

said member with said facing surface is rotatable relative to said imperforate diaphragm.

16. Apparatus as claimed in claim 14, wherein:

said member has a circular configuration at said facing surface and is rotatable relative to said imperforate diaphragm.

17. Apparatus as claimed in claim 7, wherein:

said means for coupling said portion of the other linkage part include a member being connected to said portion of the other linkage part in said enclosure and having a surface facing said imperforate diaphragm; and said means for biasing the effective length of said linkage to said extreme value include means for biasing said imperforate diaphragm toward said facing surface of said member.

18. Apparatus as claimed in claim 17, wherein:

said member with said facing surface is rotatable relative to said imperforate diaphragm.

19. Apparatus as claimed in claim 17, wherein:

said member has a circular configuration at said facing surface and is rotatable relative to said imperforate diaphragm.

20. Apparatus for assisting the driver of an automobile driven by a drive system including an internal combustion engine to improve fuel economy, said internal combustion engine drive system including an air intake manifold, a throttle valve, an accelerator pedal and a linkage coupling the accelerator pedal to the throttle valve, comprising in combination:

means in said linkage for varying the effective length of said linkage between said accelerator pedal and said throttle valve;

means in said length varying means for biasing the effective length of said linkage between said accelerator pedal and said throttle valve to an extreme value at which said throttle valve is in a closed position when said engine is deactivated;

means coupled to said throttle valve for biasing said throttle valve to a closed position;

means connected to said air intake manifold for determining the existence and intensity of a vacuum in said air intake manifold;

means in said length varying means and connected to said vacuum existence and intensity determining means for activating said throttle valve toward a closing position by variation of the effective length of said linkage in response to vacuum intensities above said vacuum intensity existing at said idling rate of rotation; and means for inhibiting surges in the operation of said engine including stop means at said length varying means for maintaining the effective length of said linkage limited to an extreme value at vacuum intensities occurring upon acceleration of said engine and being below a vacuum intensity existing in said air intake manifold at an idling rate of rotation of said internal combustion engine.

21. Apparatus as claimed in claim 20, wherein:

said means for biasing the effective length of said linkage include means for biasing the effective length of said linkage between said accelerator pedal and said throttle valve to a minimum value when said engine is deactivated;

said means for biasing said throttle valve include means for biasing said throttle valve to a closed position when the effective length of said linkage is at said minimum value and said engine is deactivated;

said means for inhibiting surges in the operation of said engine include stop means for maintaining the effective length of said linkage limited to a minimum value at vacuum intensities occurring upon acceleration of said engine and being below a vacuum intensity existing in said air intake manifold at an idling rate of rotation of said internal combustion engine; and said means connected to said vacuum existence and intensity determining means include means for increasing the effective length of said linkage so as to actuate said throttle valve toward a closing position in response to vacuum intensities above said vacuum intensity existing at said idling rate of rotation.

22. Apparatus as claimed in claim 20, wherein:

said means for biasing the effective length of said linkage include means for biasing the effective length of said linkage between said accelerator pedal and said throttle valve to a maximum value when said engine is deactivated;

said means for biasing said throttle valve include means for biasing said throttle valve to a closed position when the effective length of said linkage is at said maximum value and said engine is deactivated;

said means for inhibiting surges in the operation of said engine include stop means for maintaining the effective length of said linkage limited to a maximum value at vacuum intensities occurring upon acceleration of said engine and being below a vacuum intensity existing in said air intake manifold at an idling rate of rotation of said internal combustion engine; and said means connected to said vacuum existence and intensity determining means include means for decreasing the effective length of said linkage so as to actuate said throttle valve toward a closing position in response to vacuum intensities above said vacuum intensity existing at said idling rate of rotation.

23. Apparatus for assisting the driver of an automobile driven by a drive system including an internal combustion engine to improve fuel economy, said internal combustion engine drive system including an air intake manifold, a throttle valve, an accelerator pedal and a linkage coupling the accelerator pedal to the throttle valve, comprising in combination:

means in said linkage for varying the effective length of said linkage between said accelerator pedal and said throttle valve;

means at said length varying means for limiting the effective length of said linkage between said accelerator pedal and said throttle valve to an extreme value at which said throttle valve is in a closed position when said engine is deactivated;

means coupled to said throttle valve for biasing said throttle valve to a closed position when the effective length of said linkage is at said extreme value and said engine is deactivated;

means connected to said air intake manifold for determining the existence and intensity of a vacuum in said air intake manifold;

means in said length varying means for biasing the effective length of said linkage to said extreme value up to a vacuum intensity existing in said air intake manifold at an idling rate of rotation of said internal combustion engine;

means in said length varying means and connected to said vacuum existence and intensity determining means for activating said throttle valve toward a closing position by variation of the effective length of said linkage in response to vacuum intensities above said vacuum intensity existing at said idling rate of rotation; and means for inhibiting surges in the operation of said engine comprising stop means in said limiting means for stopping the effective length of said linkage at said extreme value at vacuum intensities occurring upon actuation of said accelerator pedal and being below said vacuum intensity existing at said idling rate of rotation.

24. Apparatus as claimed in claim 23, wherein:

said linkage has a first linkage part coupled to said throttle valve and a second linkage part coupled to said accelerator pedal;

said length varying means include an enclosure coupled to one of said first and second linkage parts and means for slidably receiving a portion of the other of said first and second linkage parts;

said limiting means and said surge inhibiting means include stop means for stopping the travel in said enclosure of said portion of said other linkage part at an extreme value;

said means for biasing the effective length of said linkage include means in said enclosure for biasing said travel of said portion of the other linkage part to said extreme value; and said means connected to said vacuum existence and intensity determining means include displaceable means connected to said portion of the other of said linkage parts and a variable size vacuum chamber delimited by said displaceable means and positioned in said enclosure to cause said displaceable means to move said other linkage part, in response to vacuum intensities above said vacuum intensity existing at said idling rate of rotation, in a direction away from said stopping of the travel of said portion of said other linkage part.

25. Apparatus as claimed in claim 23, wherein:

said limiting means include means for limiting the effective length of said linkage between said accelerator pedal and said throttle valve to a minimum value when said engine is deactivated;

said means for biasing said throttle valve include means for biasing said throttle valve to a closed position when the effective length of said linkage is at said minimum value and said engine is deactivated;

said means for biasing the effective length of said linkage include means for biasing the effective length of said linkage to said minimum value up to a vacuum intensity existing in said air intake manifold at an idling rate of rotation of said internal combustion engine;

said means connected to said vacuum existence and intensity determining means include means for increasing the effective length of said linkage so as to actuate said throttle valve toward a closing position in response to vacuum intensities above said vacuum intensity existing at said idling rate of rotation; and said surge inhibiting means include stop means for stopping the effective length of said linkage at said minimum value at vacuum intensities occurring upon actuation of said accelerator pedal and being below said vacuum intensity existing at said idling rate of rotation.

26. Apparatus as claimed in claim 25, wherein:

said linkage has a first linkage part coupled to said throttle valve and a second linkage part coupled to said accelerator pedal;

said length varying means include an enclosure coupled to one of said first and second linkage parts and means for slidably receiving a portion of the other of said first and second linkage parts;

said limiting means and said surge inhibiting means include stop means for stopping the travel in said enclosure of said portion of said other linkage part at a minimum value;

said means for biasing the effective length of said linkage include means in said enclosure for biasing said travel of said portion of the other linkage part to said minimum value; and said means connected to said vacuum existence and intensity determining means include displaceable means connected to said portion of the other of said linkage parts and a variable size vacuum chamber delimited by said displaceable means and positioned in said enclosure to cause said displaceable means to move said other linkage part in the sense of a decrease of the length of said portion of said other linkage part in said enclosure in response to vacuum intensities above said vacuum intensity existing at said idling rate of rotation.

27. Apparatus as claimed in claim 23, wherein:

said limiting means include means for limiting the effective length of said linkage between said accelerator pedal and said throttle valve to a maximum value when said engine is deactivated;

said means for biasing said throttle valve include means for biasing said throttle valve to a closed position when the effective length of said linkage is at said maximum value and said engine is deactivated;

said means for biasing the effective length of said linkage include means for biasing the effective length of said linkage to said maximum value at vacuum intensities up to a vacuum intensity existing in said air intake manifold at an idling rate of rotation of said internal combustion engine;

said means connected to said vacuum existence and intensity determining means include means for decreasing the effective length of said linkage so as to actuate said throttle valve toward a closing position in response to vacuum intensities above said vacuum intensity existing at said idling rate of rotation; and said surge inhibiting means include stop means for stopping the effective length of said linkage at said maximum value at vacuum intensities occurring upon actuation of said accelerator pedal and being below said vacuum intensity existing at said idling rate of rotation.

28. Apparatus as claimed in claim 27, wherein:

said linkage has a first linkage part coupled to said throttle valve and a second linkage part coupled to said accelerator pedal;

said length varying means include an enclosure coupled to one of said first and second linkage parts and means for slidably receiving a portion of the other of said first and second linkage parts;

said limiting means and said surge inhibiting means include stop means for stopping the travel in said enclosure of said portion of said other linkage part at a maximum value;

said means for biasing the effective length of said linkage include means in said enclosure for biasing said travel of said portion of the other linkage part to said maximum value; and said means connected to said vacuum existence and intensity determining means include displaceable means connected to said portion of the other of said linkage parts and a variable size vacuum chamber delimited by said displaceable means and positioned in said enclosure to cause said displaceable means to move said other linkage part in the sense of an increase of the length of said portion of said other linkage part in said enclosure in response to vacuum intensities above said vacuum intensity existing at said idling rate of rotation.

29. Apparatus as claimed in claim 23, wherein:

said linkage has a first linkage part coupled to said throttle valve and a second linkage part coupled to said accelerator pedal;

said length varying means include an enclosure coupled to one of said first and second linkage parts and means for slidably receiving a portion of the other of said first and second linkage parts;

said limiting means and said surge inhibiting means include stop means for stopping the travel in said enclosure of said portion of said other linkage part at an extreme value;

said means for biasing the effective length of said linkage include means in said enclosure for biasing said travel of said portion of the other linkage part to said extreme value; and said means connected to said vacuum existence and intensity determining means include an imperforate flexible diaphragm in said enclosure, means for coupling said portion of the other linkage part to said diaphragm, and a variable size vacuum chamber delimited by said flexible diaphragm and positioned in said enclosure to cause said flexible diaphragm to vary the effective length of said linkage in the sense of a closure of said throttle valve in response to vacuum intensities above said vacuum intensity existing at said idling rate of rotation.

30. Apparatus as claimed in claim 29, wherein:

said stopping means are attached to said imperforate diaphragm.

31. Apparatus as claimed in claim 29. wherein:

said stop means are bonded to said imperforate diaphragm by an adhesive.

32. Apparatus as claimed in claim 29, wherein:

said stop means include a stop member connected to said other linkage part outside of said enclosure.

33. Apparatus as claimed in claim 29, wherein:

said stop means are located inside said enclosure.

34. Apparatus as claimed in claim 29, wherein:

said means for coupling said portion of the other linkage part include a member connected to said portion of the other linkage part in said enclosure.

35. Apparatus as claimed in claim 29, wherein:

said stop means are located outside of said enclosure.

36. Apparatus as claimed in claim 29, wherein:

said means for coupling said portion of the other linkage part include a member being connected to said portion of the other linkage part in said enclosure and having a surface facing said imperforate diaphragm; and said means for biasing the effective length of said linkage to said extreme value include means for biasing said member with said facing surface toward said imperforate diaphragm.

37. Apparatus as claimed in claim 36, wherein:

said member with said facing surface is rotatable relative to said imperforate diaphragm.

38. Apparatus as claimed in claim 36, wherein:

said member has a circular configuration at said facing surface and is rotatable relative to said imperforate diaphragm.

39. Apparatus as claimed in claim 29, wherein:

said means for coupling said portion of the other linkage part include a member being connected to said portion of the other linkage part in said enclosure and having a surface facing said imperforate diaphragm; and said means for biasing the effective length of said linkage to said extreme value include means for biasing said imperforate diaphragm toward said facing surface of said member.

40. Apparatus as claimed in claim 39, wherein:

said member with said facing surface is rotatable relative to said imperforate diaphragm.

41. Apparatus as claimed in claim 39, wherein:

said member has a circular configuration at said facing surface and is rotatable relative to said imperforate diaphragm.

* * * * *